US006190243B1

(12) United States Patent
Wada et al.

(10) Patent No.: US 6,190,243 B1
(45) Date of Patent: Feb. 20, 2001

(54) POLISHING APPARATUS

(75) Inventors: Yutaka Wada, Kanagawa-ken; Hirokuni Hiyama, Tokyo; Kazuto Hirokawa; Hisanori Matsuo, both of Kanagawa-ken, all of (JP)

(73) Assignee: Ebara Corporation, Tokyo (JP)

( * ) Notice: Under 35 U.S.C. 154(b), the term of this patent shall be extended for 0 days.

(21) Appl. No.: 09/306,985

(22) Filed: May 7, 1999

(30) Foreign Application Priority Data

May 7, 1998 (JP) ..... 10-124670

(51) Int. Cl.[7] ..... B24B 21/18

(52) U.S. Cl. ..... 451/288; 451/56; 451/443; 451/285

(58) Field of Search ..... 457/56, 41, 443, 457/444, 285–289, 21; 156/636.1, 645.1; 216/88, 89; 125/11.03

(56) References Cited

U.S. PATENT DOCUMENTS 5,154,021 * 10/1992 Bombardier et al. ..... 451/444
5,611,943 * 3/1997 Cadien et al. ..... 451/444
5,775,983 * 7/1998 Shendon et al. ..... 451/287
5,938,507 * 8/1999 Ko et al. ..... 451/41
5,975,994 * 11/1999 Sandhu et al. ..... 451/56
5,997,385 * 12/1999 Nishio ..... 451/56

FOREIGN PATENT DOCUMENTS 9-225812 9/1997 (JP) .

* cited by examiner

*Primary Examiner*—David A. Scherbel
*Assistant Examiner*—George Nguyen
(74) *Attorney, Agent, or Firm*—Wenderoth, Lind & Ponack, L.L.P.

(57) ABSTRACT

A polishing apparatus comprises a table having a smooth surface, a polishing pad provided on the smooth surface and a carrier for carrying an article to be polished The carrier brings the article into engagement with the pad under a pressure. The carrier and the table with the polishing pad are repeatedly moved relative to each other in a predetermined direction to thereby polish the article. A pressing device is positioned at a position spaced from the carrier is and adapted to be engaged with the polishing surface of the polishing pad. The pressing device includes a plurality of pressing elements which are arranged across an area of the polishing surface which area is to be brought into engagement with the article carried by the carrier and are adapted to individually press successive corresponding portions in the area to arrange the configuration of the surface of the area under corresponding various pressures.

17 Claims, 5 Drawing Sheets

POLISHING APPARATUS

BACKGROUND OF THE INVENTION

Figure 1:
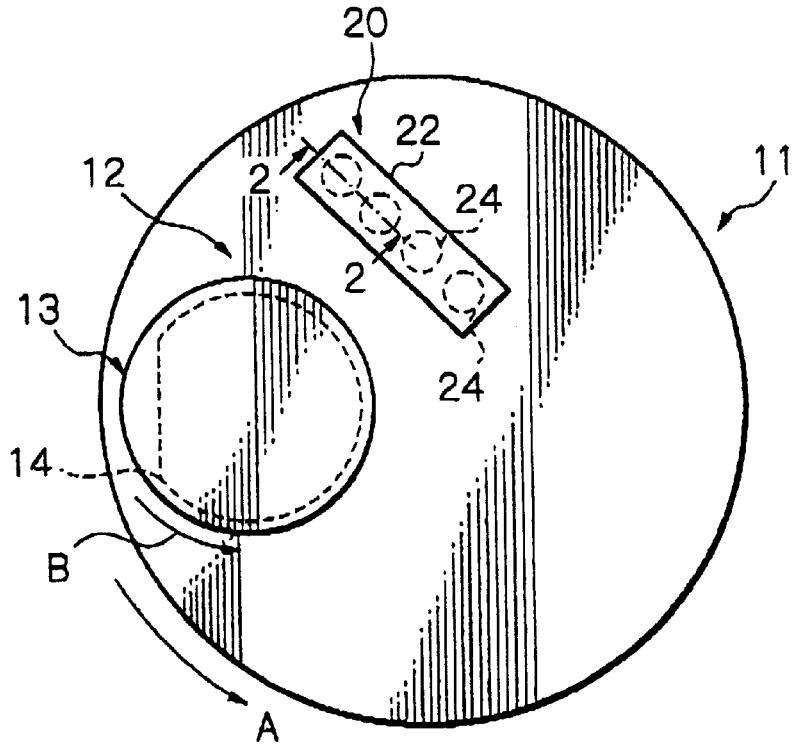

The present invention relates to a polishing apparatus, in particular, a semiconductor wafer polishing apparatus.

For example, in the fabrication of semiconductor devices, it is usually necessary for a semiconductor wafer to be subject to a precise polishing process known as chemical-mechanical planarization ("CMP") to polish and planarize a top surface of the wafer. In the polishing process, a top surface of a wafer carried by a carrier is brought into a contact with a polishing surface of a resilient polishing pad provided on a turntable under a pressure while a slurry is supplied onto the polishing surface, whereby the top surface of the wafer is mechanically and chemically polished and planarized Accordingly, it is desired that the pressure between the top surface of the wafer and the polishing surface of the polishing pad is uniform all over the top surface of the wafer. However, it is generally difficult to attain and/or maintain such a uniform pressure, mainly due to unevenness of the polishing surface of the polishing pad, whereby it becomes difficult to planarize the top surface of the wafer to a desirable extent.

A main cause of such unevenness in the polishing surface resides in a relationship of engagement between a top surface of a wafer which is commonly in the shape of a circle and a polishing surface of a resilient polishing pad. The wafer is engaged with the polishing surface of the resilient polishing pad at a position offset from the turning center of the polishing pad on a turntable and thus along a circular ring-shaped path on the polishing surface of the turning polishing pad. Accordingly, among the points on the polishing surface which engage with the wafer, a point on a circle about the center of the polishing surface which goes through the center of the wafer is pressed for the longest time per turn of the polishing pad, and points circles about the center of the polishing surface which go through the radially innermost and outermost points of the wafer relative to the center of the polishing pad are pressed for the shortest time, and vice versa for the time periods during which those points are freed from pressing by the wafer to restore their initial levels. As a result, the surface of the polishing pad which is brought into engagement with the wafer becomes uneven, whereby the pressure between the wafer and the polishing surface varies depending on radial engaging positions therebetween.

To solve such a problem, it was devised that a wafer carrier is provided with an air pressure chamber and a flexible seal member defining the bottom of the pressure chamber which supports a wafer on the outer surface thereof, whereby the wafer is yieldably urged against a polishing pad by the air pressure in the pressure chamber. However, it is difficult for this method to adequately cope with the uneveness of the polishing surface which may be formed Japanese Laid-Open Patent Application H9-225812 (JP -209225812A) discloses another method for solving the above-noted problem in which a pressing device is provided at a position spaced from a wafer carrier so as to press an area of a polishing surface of a polishing pad which is to be brought into engagement with the wafer carried by the wafer carrier with a pressure equal to or greater than the pressure between the wafer and the polishing surface of the polishing pad so that the pressing device planarizes the area to attain a uniform pressure between the wafer and the polishing pad.

However, various causes other than that above-noted are considered to relate to differences in pressures between a polishing surface of a polishing pad and a wafer and it is difficult for the method disclosed in the above-noted Japanese Application to appropriately cope with the problem of differences in pressures between the wafer and the polishing surface.

SUMMARY OF THE INVENTION

An object of the present invention is therefore to provide a polishing apparatus which solves the problem discussed above.

In accordance with the present invention, a polishing apparatus comprises a table having a smooth surface, a polishing pad provided on the smooth surface, a carrier for carrying an article to be polished, the carrier being adapted to bring the article into engagement with the pad under a pressure, the carrier and the table with the polishing pad being repeatedly moved relative to each other in a predetermined direction to thereby polish the article, a pressing device positioned at a position spaced from the carrier and adapted to be engaged with the polishing surface of the polishing pad, the pressing device including a plurality of pressing elements which are arranged across an area of the polishing surface, which area is to be brought into engagement with the article carried, by the carrier and are adapted to individually press successive corresponding portions in the area, to arrange the configuration of the surface of the area under corresponding pressures.

The apparatus further includes a surface detecting device provided over the polishing surface to detect the configuration of the surface of the area of the polishing surface along a line extending transversely of the area, and the pressing elements are adapted to depress the area of the polishing surface with pressures determined on the basis of the configuration of the area of the polishing surface.

The above features and advantages of the present invention will be become apparent from the following description and the appended claims taken in conjunction with the accompanying drawings.

BRIEF DESCRIPTION-OF THE DRAWINGS

Figure 2:
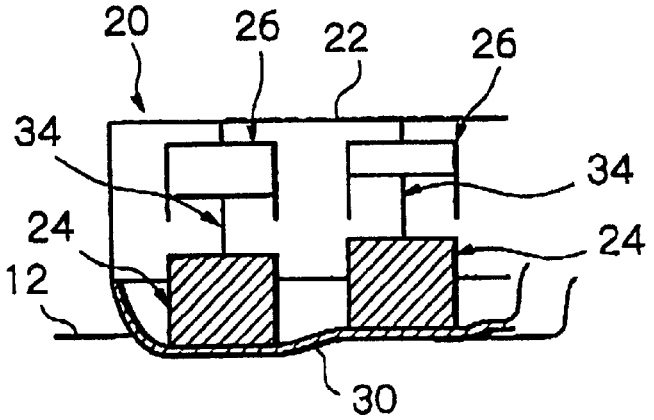
Figure 3:
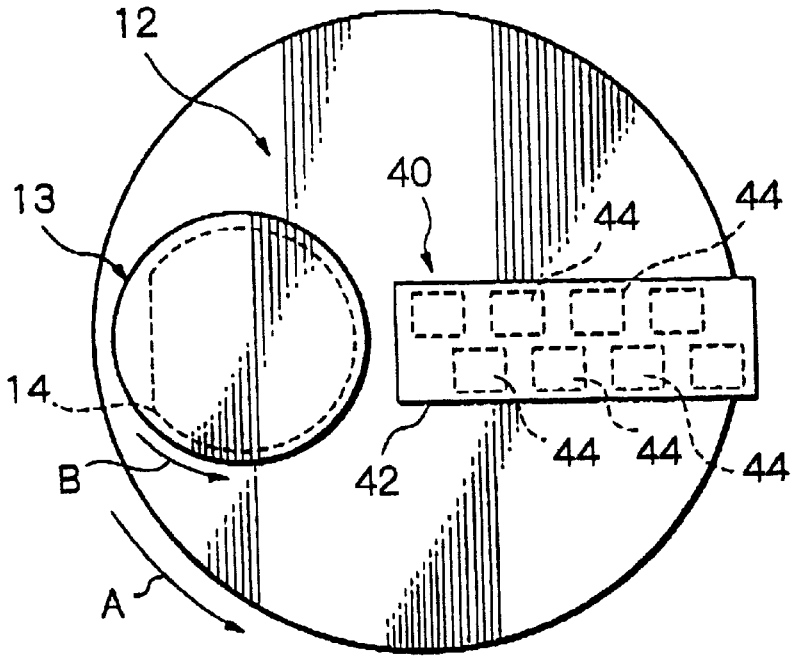
Figure 4:
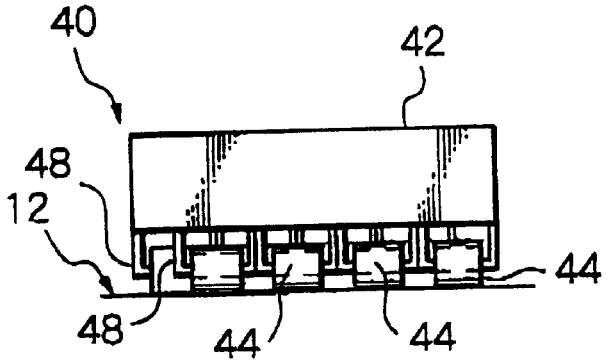
Figure 5:
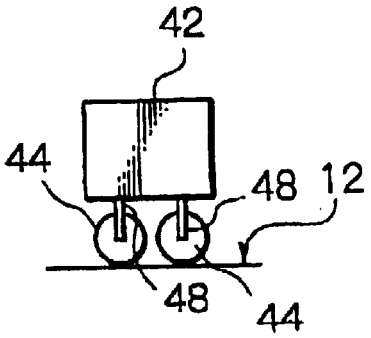
Figure 6:
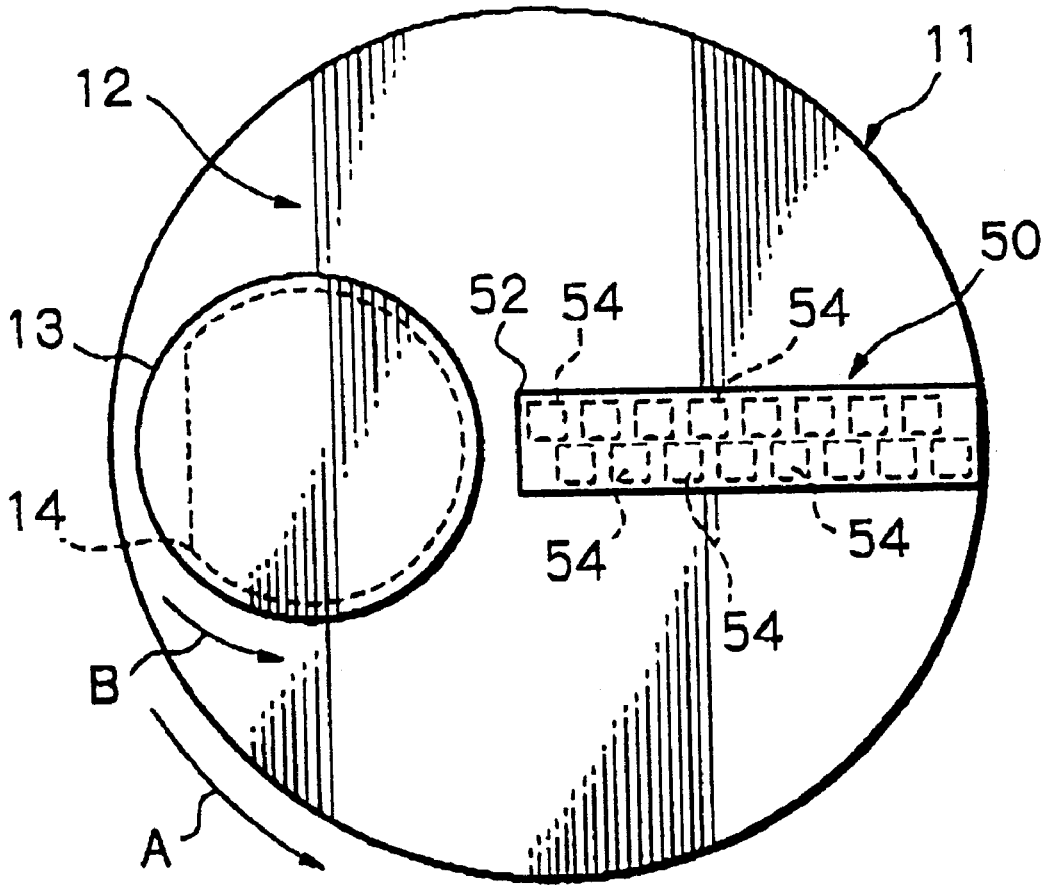
Figure 7:
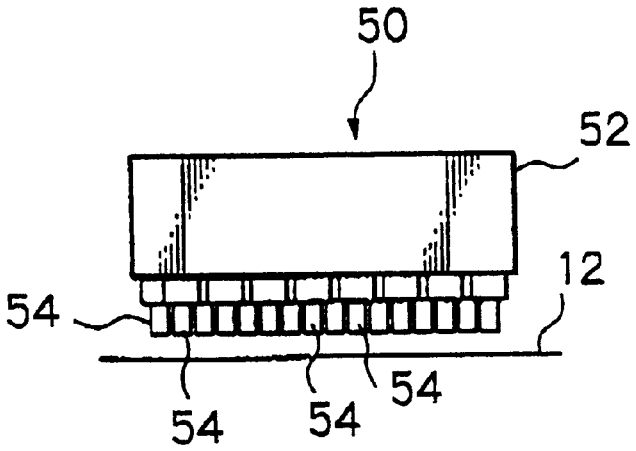
Figure 8:
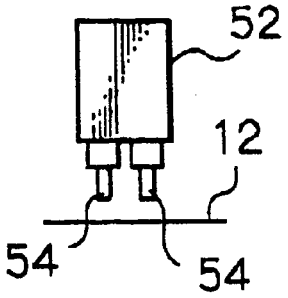
Figure 9:
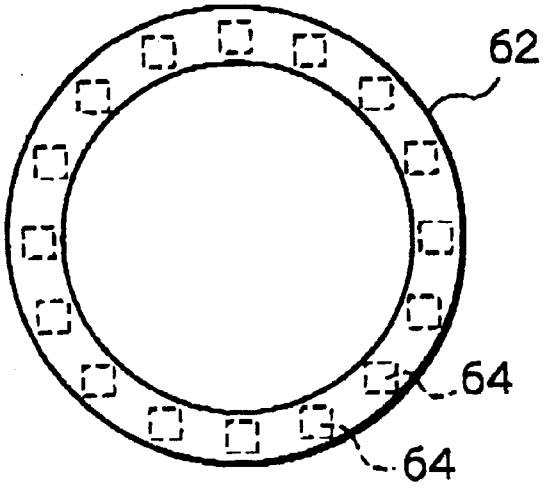
Figure 10:
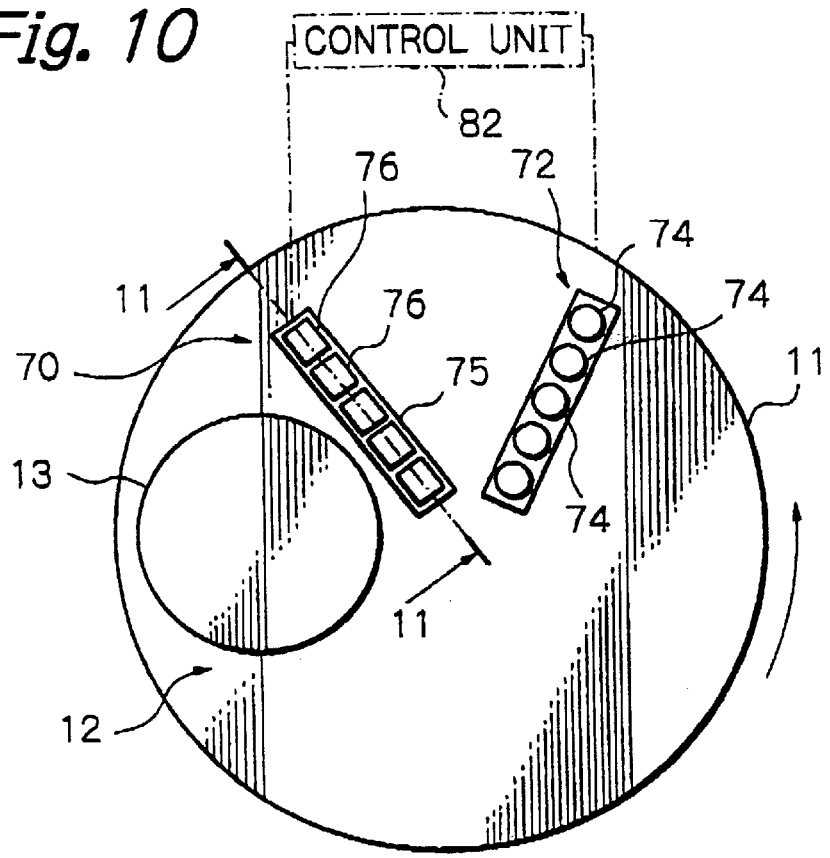
Figure 11:
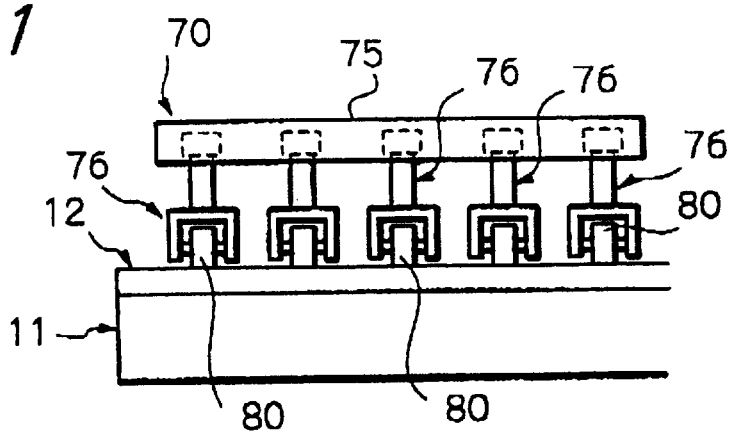
Figure 12:
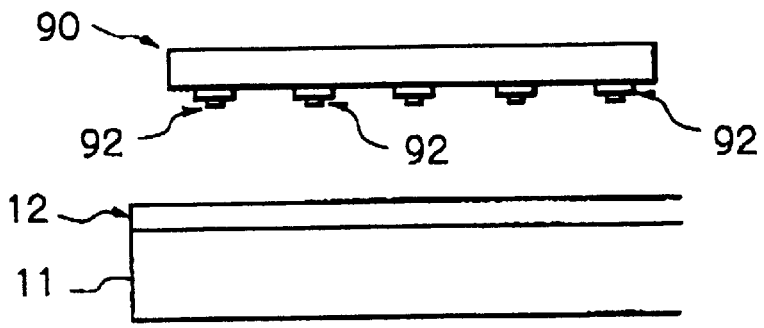

FIG. 1 is a schematic plan view of a polishing apparatus in accordance with a first embodiment of this invention, FIG. 2 is a view taken along a line 2—2 in FIG. 1, FIG. 3 is a schematic plan view of a polishing apparatus in accordance with a second embodiment of this invention, FIG. 4 is a front view of a pressing device in the polishing apparatus shown in FIG. 3, FIG. 5 is a side elevation view of the pressing device shown in FIG. 4, FIG. 6 is a schematic plan view of a polishing apparatus in accordance with a third embodiment of this invention, FIG. 7 is a front view of a pressing device in the polishing apparatus shown in FIG. 6, FIG. 8 is a side elevation view of the pressing device shown in FIG. 7, FIG. 9 is a plan view of a pressing device in accordance with a fourth embodiment of this invention, FIG. 10 is a schematic plan view of a polishing apparatus in accordance with a fifth embodiment of this invention, FIG. 11 is a view taken along a line 11—11 in FIG. 10 showing a surface configuration detecting device, and FIG. 12 is a view similar to FIG. 11 showing a surface configuration detecting device in accordance with another embodiment.

DETAILED DESCRIPTION OF THE INVENTION

Referring to FIGS. 1 and 2, there is shown a polishing apparatus in accordance with the first embodiment of this invention which includes a turntable 11 drivingly rotated in the counter-clockwise direction A (as viewed in FIG. 1), a resilient polishing pad 12 provided over the upper surface of the turntable 11 and a carrier 13 for carrying and holding an article such as a semiconductor wafer 14 to be polished. The carrier is usually provided with a ring adapted to be positioned around an article carried by the carrier to positively hold the article under the carrier. The carrier is adapted to be drivingly rotated about its axis in the counter-clockwise direction B (as viewed in FIG. 1). The polishing apparatus further includes a pressing device 20 positioned at an upstream position in a rotational direction of the turntable 11 with the polishing pad 12 relative to the carrier 13. The pressing device 20 includes an elongated frame 22 in the shape of a reversed elongated box extending generally in a radial direction of the turntable 11, a plurality of pressing elements 24 (i.e., four pressing elements in this particular embodiment) provided inside of and arranged along the elongated frame 22, a plurality of actuators 26 fixedly provided inside of the frame 22 and connected to the corresponding pressing elements 24, and a flexible sheet 30 fixedly connected to the elongated frame in such a manner that the sheet encloses the pressing elements 24 inside the frame 22 and are engageable with the polishing surface of the polishing pad 12. The pressing elements 24 are connected to the upper or inner surface of the flexible sheet 30 and connected to the lower ends of piston-rods 34 of the corresponding piston-cylinder type actuators 26, whereby the pressing elements 24 are individually actuated by the actuators to press through the flexible sheet 30 the polishing pad 12 with pressures which are individually determined by the actuators 26. When this polishing apparatus is used in the so-called chemical mechanical planarization (CMP) process for semiconductor wafers, a slurry nozzle (not shown) is provided over the polishing pad to supply a slurry to the polishing pad.

In operation, the turntable 11 with the polishing pad is rotated in the direction A and the carrier 13 with the article 14 to be polished is rotated in the direction B while the article is engaged with the polishing surface of the polishing pad 12. Simultaneously, the pressing elements 24 are individually actuated by the corresponding actuators 26 to press through the flexible sheet 30 an area of the polishing surface of the polishing pad which is to be brought into engagement with the wafer 14 carried by the carrier due to the rotation of the polishing pad 12, to adjust the configuration of the surface of the area along a line extending generally in a radial direction of the polishing pad 12, so that the pressures between the article to be polished and the polishing pad are optimized for the purpose of proper planarization of the surface of the wafer.

A control system which can be employed in the polishing apparatus to control the actuators 26 will be explained later with reference to an embodiment shown FIGS. 10–12, which control system is also applicable to the other embodiments explained hereinbelow.

FIGS. 3–5 show a polishing apparatus in accordance with a second embodiment of this invention which is generally the same as that of the first embodiment described above except for a pressing device 40. The pressing device 40 includes a rectangular box-like frame 42, a plurality of pressing elements (i.e., eight pressing members in this particular embodiment) 44 in the shape of rollers and a plurality of actuators (not shown) provided inside of the frame 42 for actuating the corresponding pressing elements 44. As shown, the pressing elements 44 are arranged in a staggered fashion in two rows extending generally in a radial direction of the polishing pad 12. Each of the pressing elements or rollers 44 is connected to the corresponding actuator by means of a support frame 48 in such a manner that the roller 44 is, in operation, rotated by the turning turntable.

In operation, the pressing elements 44 are individually actuated by the corresponding actuators to directly press an area of the polishing surface of the polishing pad which is to be brought into engagement with the wafer 14 carried by the carrier due to the rotation of the polishing pad 12, to adjust the configuration of the surface of the area along a line extending generally in a radial direction of the polishing pad 12, so that the pressures between the article to be polished and the polishing pad are optimized for the purpose of proper planarization of the surface of the wafer.

FIGS. 6–8 show a polishing apparatus in accordance with the third embodiment of this invention which is generally the same as that shown in FIGS. 3–5 except for a pressing device 50. The pressing device 50 includes a rectangular box-like frame 52, a plurality of pressing elements (i.e., sixteen pressing elements in this particular embodiment) 54 in the form of air nozzles and a pressurized air supply line system (not shown) provided inside of the frame 52 for individually supplying pressurized air flows to the nozzles or pressing elements 54. The pressurized air supply system includes discrete air supply lines each of which is provided with a solenoid valve to control the air flow supplied to the corresponding nozzle. As shown, the nozzles 54 are arranged in a staggered fashion in two rows extending generally in a radial direction of the polishing pad 12.

In operation, the pressing elements or nozzles 54 direct air jets towards the polishing pad to press an area of the polishing surface of the polishing pad which is to be brought into engagement with the wafer 14 carried by the carrier due to the rotation of the polishing pad 12, to adjust the configuration of the surface of the area along a line extending generally in a radial direction of the polishing pad 12, so that the pressures between the article to be polished and the polishing pad are optimized for the purpose of proper planarization of the surface of the wafer.

The arrangement of the nozzles 54 is not limited to the above-noted two-row staggered fashion. FIG. 9 shows another arrangement of a fourth embodiment in which a plurality of nozzles 64 are positioned along a circular frame 62. In this case, the circular frame 62 should have a diameter which is large enough to extend across an area of a polishing pad to be brought into engagement with a wafer. In this embodiment, the air nozzles 54 may be replaced with nozzles for directing jets of other kinds of fluids such as inert gases including nitrogen gas and liquids including pure water and water containing various chemicals such as slurries.

FIGS. 10–12 show a polishing apparatus in accordance with the fourth embodiment of this invention which has a surface configuration detecting device 70 to control a pressing device 72. The pressing device 72 may be any one of those described above and includes a plurality of pressing elements 74. The detecting device 70 includes an elongated frame 75 positioned adjacent to and upstream of the wafer carrier 13 and extending in a radial direction of the polishing pad 12 and a plurality of surface level detecting elements 76 provided on the frame 75, the radial positions of the surface level detecting elements 76 with respect to the polishing pad corresponding to those of the pressing elements 74. Each of the detecting elements 76 includes a rolling element 80 adapted to be engaged with the polishing surface of the polishing pad 12 so that, in the polishing operation, the rolling element 80 is moved in a vertical direction depending on the level of the point of the polishing surface of the turning polishing pad which point has come into contact with the rolling element 80 while rolling on the polishing surface. The detecting element 76 may be in the form of a dial gauge. The detecting device 76 generates signals representative of the surface levels detected by the respective detecting elements and delivers them to a control unit 82. The control unit 82 then determines magnitudes of pressures with which the respective pressing elements 74 should press the polishing pad and controls the actuators accordingly.

FIG. 12 shows another type of surface configuration detecting device 90 which employs, in place of such contact type surface level detecting elements as shown in FIGS. 10 and 11, non-contact type surface level detecting elements 92 adapted to detect the levels of the polishing surface of the polishing pad 12 without engagement with the polishing surface by means of, for example, laser beams.

In accordance with the embodiments shown in FIGS. 10–12, the pressing device 72 is controlled on the basis of detection of the surface configuration or levels of a polishing surface of a polishing pad by means of the surface configuration detecting device. It should be noted, however, that the pressing device can instead be controlled or adjusted by detecting a condition of a surface of an article which has been polished. For example, in a polishing operation of a semiconductor wafer, the pressing device may be controlled on the basis of a measurement of a thickness of the top layer formed on the wafer. Further, Although in the embodiment shown in FIG. 10 and 11 the detecting device 70 is positioned just upstream of the wafer carrier and the pressing device 72 is positioned upstream of the detecting device 70, the positional relationship between the detecting device 70 and the pressing device 72 may be reversed, i.e., the pressing device may be positioned just upstream of the wafer carrier and the detecting device 70 may be positioned upstream of the pressing device 72.

As stated above, the pressing devices as described above positively conform a surface configuration of a polishing surface of a polishing pad, thereby enabling a pressure between the polishing surface of the polishing pad and an article to be polished to be uniform. Additionally, when the polishing apparatuses as described above are used in the so-called chemical mechanical planarization process, the conforming of a polishing surface of a polishing pad by means of the pressing device will lessen the amount of frictional wear of a ring which is commonly positioned coaxially with and radially outside of a wafer carrier to press a polishing surface of a polishing pad aimed at preventing an excessive local polishing of an outer edge portion of a circular semiconductor wafer, and further will lessen the number of dressing or conditioning operations which are needed to condition the polishing surface of the polishing pad, usually by rubbing the polishing surface with a rotating brush or a rotating conditioning circular plate a surface of which is provided with diamond particles thereon and adapted to be engaged with the polishing surface of the polishing pad thereby prolonging the duration of the polishing pad.

While the invention is susceptible to various modifications and alternative forms, specific embodiments thereof have been shown by way of example and were herein described in detail. It should be understood, however, that it is not intended to limit the invention to the particular forms disclosed, but on the contrary, the intention is to cover all modifications, equivalents and alternatives falling within the spirit and scope of the invention as defined by the appended claims.

What is claimed is:

1. A polishing apparatus comprising:

a table having a surface;

a polishing pad provided on said surface of said table and having a polishing surface;

a carrier to carry an article to be polished and to bring the article into engagement with said polishing surface under pressure;

said table with said polishing pad and said carrier being movable relative to each other during a polishing operation, to thereby polish the article carried by said carrier; and a pressing device, located at a position spaced from said carrier, to be engaged with said polishing surface of said polishing pad during said polishing operation, said pressing device including:

a plurality of pressing elements arranged across an area of said polishing surface that is to be brought into engagement with the article carried by said carrier; and said pressing elements being individually operable, during said polishing operation, to press, under respective pressures, corresponding portions of said polishing surface in said area.

2. An apparatus as claimed in claim 1, wherein said pressing device further includes a plurality of actuators to individually actuate respective of said pressing elements to press said corresponding portions of said polishing surface at said respective pressures determined by said actuators.

3. An apparatus as claimed in claim 2, wherein said actuators comprise piston-cylinder devices.

4. An apparatus as claimed in claim 3, further comprising a surface detecting device, arranged along a line extending transverse to said area of said polishing surface, to detect the configuration of said area, said actuators being operable in response to said surface detecting device to press said corresponding portions of said area under said respective pressures.

5. An apparatus as claimed in claim 2, wherein each said pressing element comprises a roller to be brought into engagement with said polishing surface, such that said roller is rotated by said polishing surface when said roller is in engagement therewith.

6. An apparatus as claimed in claim 5, further comprising a surface detecting device, arranged along a line extending transverse to said area of said polishing surface, to detect the configuration of said area, said actuators being operable in response to said surface detecting device to press said corresponding portions of said area under said respective pressures.

7. An apparatus as claimed in claim 2, further comprising a surface detecting device, arranged along a line extending transverse to said area of said polishing surface, to detect the configuration of said area, said actuators being operable in response to said surface detecting device to press said corresponding portions of said area under said respective pressures.

8. An apparatus as claimed in claim 1, wherein said pressing device further includes a flexible sheet member positioned between said pressing elements and said polishing surface, such that said pressing elements press through said flexible sheet member said corresponding portions of said polishing surface in said area.

9. An apparatus as claimed in claim 8 further comprising a surface detecting device, arranged along a line extending transverse to said area of said polishing surface, to detect the configuration of said area, said pressing elements being operable in response to said surface detecting device to press said corresponding portions of said area under said respective pressures.

10. An apparatus as claimed in claim 1, wherein each said pressing element comprises a fluid jet nozzle to direct a fluid jet toward said corresponding portion of said polishing surface in said area.

11. An apparatus as claimed in claim 10, wherein each said fluid jet nozzle comprises an air nozzle to direct a high pressure air jet toward said corresponding portion of said polishing surface in said area.

12. An apparatus as claimed in claim 11, further comprising a surface detecting device, arranged along a line extending transverse to said area of said polishing surface, to detect the configuration of said area, said air nozzles being operable in response to said surface detecting device to direct air jets toward said corresponding portions of said area under said respective pressures.

13. An apparatus as claimed in claim 10, further comprising a surface detecting device, arranged along a line extending transverse to said area of said polishing surface, to detect the configuration of said area, said fluid nozzles being operable in response to said surface detecting device to direct fluid jets toward said corresponding portions of said area under said respective pressures.

14. An apparatus as claimed in claim 1, further comprising a surface detecting device, arranged along a line extending transverse to said area of said polishing surface, to detect the configuration of said area, said pressing elements being operable in response to said surface detecting device to press said corresponding portions of said area under said respective pressures.

15. An apparatus as claimed in claim 14, wherein said surface detecting device comprises a plurality of contact detectors arranged in said line to contact said polishing surface to detect said configuration of said area.

16. An apparatus as claimed in claim 15, wherein each said detector comprises a rolling element to be rotated by contact with said polishing surface.

17. An apparatus as claimed in claim 14, wherein said surface detecting device comprises a plurality of non-contact detectors arranged in said line and spaced from said polishing surface to detect levels of respective portions of said polishing surface.

* * * * *